US008500324B2

(12) United States Patent
Born et al.

(10) Patent No.: US 8,500,324 B2
(45) Date of Patent: Aug. 6, 2013

(54) TIMEPIECE MOVEMENT FITTED WITH A VIBRATING ALARM

(75) Inventors: Jean-Jacques Born, Morges (CH); Cédric Nicolas, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 217 days.

(21) Appl. No.: 12/974,616

(22) Filed: Dec. 21, 2010

(65) Prior Publication Data

US 2011/0149697 A1 Jun. 23, 2011

(30) Foreign Application Priority Data

Dec. 22, 2009 (EP) ..... 09180449.2

(51) Int. Cl.
*G04B 5/02* (2006.01)

(52) U.S. Cl.
USPC ..... 368/148; 368/207; 368/244; 368/260

(58) Field of Classification Search
USPC ..... 368/72, 147, 148, 149, 150, 203, 368/206, 207, 208, 230, 244, 259, 260
See application file for complete search history.

(56) References Cited

U.S. PATENT DOCUMENTS

| | | | | |
|---|---|---|---|---|
| 1,483,768 | A * | 2/1924 | Bickerton | 368/244 |
| 2,305,666 | A | 12/1942 | Bolsey | |
| 2,667,737 | A | 2/1954 | Gazda | |
| 2,739,682 | A | 3/1956 | Detwiler | |
| 2,756,559 | A | 7/1956 | Derr | |
| 2,874,532 | A | 2/1959 | Baier | |
| 3,349,555 | A * | 10/1967 | Bridevaux | 368/244 |
| 3,479,813 | A * | 11/1969 | Kocher | 368/142 |
| 3,621,647 | A * | 11/1971 | Erard et al. | 368/148 |
| 3,732,686 | A * | 5/1973 | Zaugg | 368/37 |
| 4,799,204 | A * | 1/1989 | Kitaoka et al. | 368/263 |
| 5,023,853 | A | 6/1991 | Kawata et al. | |
| 5,362,497 | A * | 11/1994 | Yamada et al. | 424/449 |
| 5,397,505 | A * | 3/1995 | Rieger et al. | 252/299.67 |
| 5,878,004 | A | 3/1999 | Miyauchi et al. | |
| 6,349,075 | B1 | 2/2002 | Miyauchi et al. | |
| 7,322,742 | B2 * | 1/2008 | Goeller et al. | 368/147 |

(Continued)

FOREIGN PATENT DOCUMENTS

| | | | |
|---|---|---|---|
| CH | 207 379 | A | 10/1939 |
| CH | 287 622 | A | 12/1952 |

(Continued)

OTHER PUBLICATIONS

Search Report issued in corresponding application No. EP 09 18 0449, completed Apr. 23, 2010.

(Continued)

*Primary Examiner* — Vit W Miska
*Assistant Examiner* — Matthew Powell
(74) *Attorney, Agent, or Firm* — Griffin & Szipl, P.C.

(57) ABSTRACT

Timepiece movement 1 including an energy source 36 coupled to an oscillating weight 2 by a first kinematic chain 3 for automatically winding the movement 1, the timepiece movement 1 being characterized in that the energy source 36 is also coupled to an actuation device 41 and a vibrating element 42 via a second kinematic chain 4 to form a vibrating alarm mechanism that can be released at a predetermined time.

18 Claims, 3 Drawing Sheets

U.S. PATENT DOCUMENTS

| | | | | |
|---|---|---|---|---|
| 7,896,542 | B2 | 3/2011 | Born et al. | |
| 2008/0101163 | A1* | 5/2008 | Bravo et al. | 368/148 |
| 2008/0273426 | A1* | 11/2008 | Corthesy et al. | 368/262 |
| 2010/0135127 | A1 | 6/2010 | Born et al. | |

FOREIGN PATENT DOCUMENTS

| | | | |
|---|---|---|---|
| CH | 324 754 | A | 10/1957 |
| CH | 330 203 | A | 5/1958 |
| CH | 343 928 | A | 12/1959 |
| CH | 345 607 | A | 3/1960 |
| DE | 11 04 900 | B | 4/1961 |
| DE | 12 08 698 | B | 1/1966 |
| EP | 0 547 250 | A1 | 6/1993 |
| EP | 1 980 922 | A1 | 10/2008 |
| FR | 2 196 490 | | 8/1972 |

OTHER PUBLICATIONS

Article concerning a wristwatch marketed by Jaeger Lecoultre as "Master Grand Reveil," published 2006.

B. Humbert, "La Montre Suisse A Remontage Autonmatique," Du Journal Suisse D'Horlogerie et de Bijouterie (1955).

"Master Grand Reveil—Jaeger-LeCoultre," at http://collection.jaeger-lecoultre.com/FR/fr/watches/master-grand-reveil/163842A (downloaded Jan. 23, 2013.

European Search Report issued in related application EP 08 02 0803, completed May 27, 2009.

* cited by examiner

TIMEPIECE MOVEMENT FITTED WITH A VIBRATING ALARM

This application claims priority from European Patent Application No. 09180449.2 filed Dec. 22, 2009, the entire disclosure of which is incorporated herein by reference.

FIELD OF THE INVENTION

The invention concerns timepiece movements that include alarm mechanisms, and in particular automatically wound movements of this type that include vibrating alarms, said movements being intended for wristwatches, and pocket watches or suchlike.

BACKGROUND OF THE INVENTION

A wristwatch marketed by the Jaeger Lecoultre Company under the reference "Master Grand Reveil", includes an alarm mechanism for automatically setting off an alarm at a time predefined by the user. This alarm function is performed by a mechanism connected to the movement, which includes an independent barrel, a setting system for programming the alarm time, a release mechanism that is connected to the gear train of the movement and actuates the alarm at the appointed time, and a strike work for alerting the user. The strike work includes both a gong which is struck by a hammer to generate an acoustic signal and means for vibrating the watch without generating an audible acoustic signal. There is a switch for selecting whether to release an acoustic alarm or a silent vibrating alarm.

This watch has, however, drawbacks. Indeed, the alarm mechanism requires an additional power source and includes elements that are specifically for the silent alarm operating mode of the mechanism, which increases the complexity and size of the structure. Moreover, the vibration amplitude is limited.

SUMMARY OF THE INVENTION

It is a main object of the present invention to overcome one or more of these drawbacks of the aforementioned prior art by providing an automatically wound timepiece movement that advantageously uses the energy stored by the barrel of a basic, automatically wound movement to actuate an alarm mechanism.

It is also an object of the present invention to provide an automatically wound timepiece movement that includes a silent vibrating alarm mechanism that advantageously uses elements of the movement and produces large amplitude vibration.

Another object of the invention is to provide a timepiece movement that includes this type of alarm device with a design that is particularly simple and inexpensive to implement in the movement.

The invention therefore concerns a timepiece movement 1 including an energy source 36 coupled to an oscillating weight 2 via a first kinematic chain 3 for automatically winding movement 1, the timepiece movement 1 being characterized in that energy source 36 is also coupled to an actuating device 41 and a vibrating element 42 via a second kinematic chain 4 to form a vibrating alarm mechanism that can be set off at a predetermined time.

The vibrating alarm mechanism thus obtained has the advantage of being simplified and not requiring a dedicated energy source. This saves space for housing other modules in the watch case, such as for example a chronograph module, without requiring any increase in the watch calibre. Moreover, the use of the oscillating weight as the vibrating element in accordance with a preferred embodiment of the invention both provides larger amplitude vibrations than with a conventional vibrating element and at the same time, also reduces the number of parts to be assembled, as does reusing numerous parts of the winding train, in accordance with a preferred variant. This leads to easier assembly and a decrease in manufacturing costs for a watch that includes this type of movement.

BRIEF DESCRIPTION OF THE DRAWINGS

Other features and advantages of the invention will appear clearly from the following description, made with reference to the annexed drawings, in which.

DETAILED DESCRIPTION OF THE PREFERRED EMBODIMENTS

Figure 1:
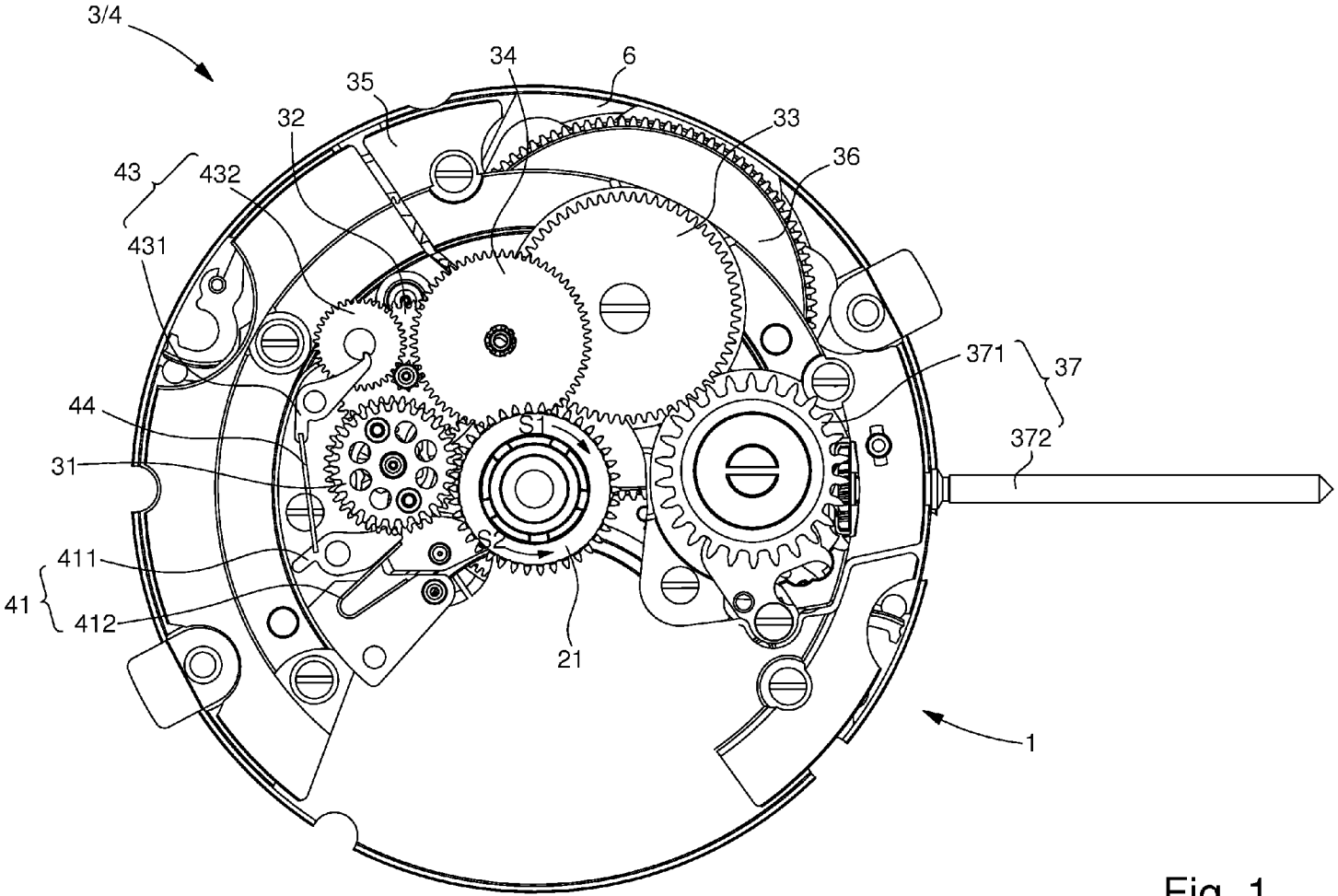
FIG. 1 is a top view of the movement of FIG. 1 forming a vibrating alarm according to a preferred embodiment of the invention, in cross-section at the level of the weight pinion.

FIG. 1 shows a top view of a timepiece movement 1 of a wristwatch according to a preferred variant of the invention. The proposed timepiece movement 1 associates a vibrating alarm mechanism with a timepiece movement that includes an automatic winding mechanism, which is known to those skilled in the art. This automatic winding mechanism of movement 1 uses the rotation of an oscillating weight 2 (visible below in FIGS. 2 and 3) for storing mechanical energy in a barrel 36 via a gear train 31, 32, 34 forming a kinematic chain 3, which meshes on weight pinion 21 of oscillating weight 2 (shown in FIG. 2) which forms a toothed wheel. Owing to the shift in the centre of gravity of oscillating weight 2 relative to the axis of rotation thereof, which is also the axis of rotation of weight pinion 21, the user's wrist movements cause oscillating weight 2 to rotate relative to the watch case; this rotation of oscillating weight 2 causes ratchet wheel 33 of barrel 36 to rotate at the exit of kinematic chain 3. The rotation of ratchet wheel 33 winds the spring inside barrel 36 and thus stores mechanical energy that will be distributed towards a going train 7 (not shown in this Figure but visible in FIG. 3), which meshes on the teeth of barrel 36. According to the preferred embodiment illustrated in FIG. 1, this winding mechanism is the type that winds in only one direction, owing to a conventional reverser wheel 31, as described for example at pages 35, 37 of the book "La montre Suisse à remontage automatique" by B. Humbert, and the operation of which will be explained below. Wheel sets 32 and 34 are reduction wheel sets, each including a coaxial, integral wheel and pinion, and their purpose is to establish a suitable gear ratio for adjusting the rotational speed to be obtained at the exit of gear train 3 in accordance with that of weight pinion 21. The wheels and pinions of all the wheel sets of the gear train are illustrated in FIG. 3, which clearly shows the gearing of the various elements in relation to each other.

Figure 2:
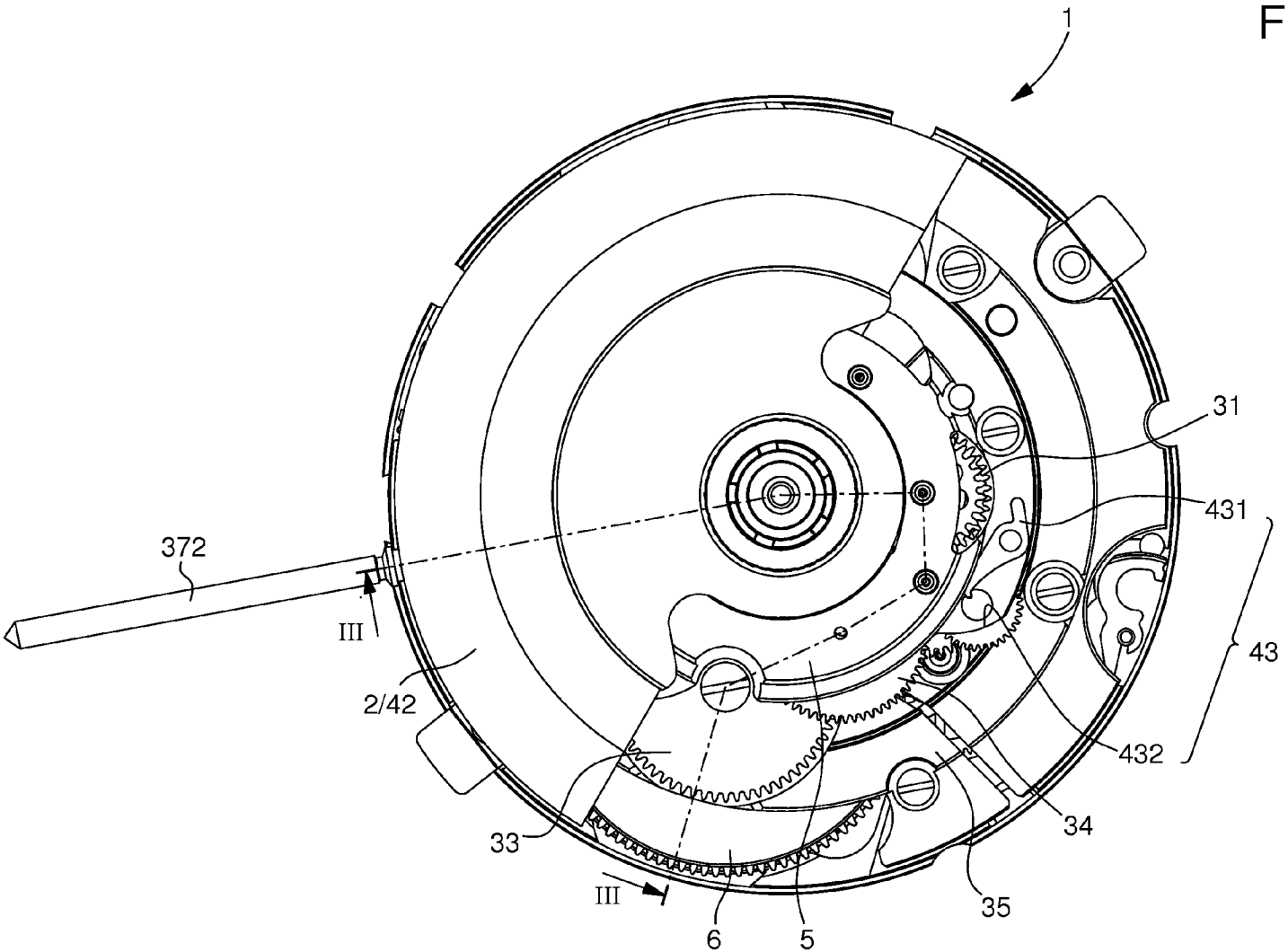
FIG. 2 is a top view of the device according to the preferred embodiment of the invention, with the oscillating weight assembled.

As shown in FIG. 2, oscillating weight 2 is rotatably mounted on a support 5 fixed to a bottom plate 6, which is in turn fixed in the watch case. Reverser wheel 31 is also rotatably mounted on support 5, which has suitable cut out portions such that weight pinion 21 of oscillating weight 2 is meshed with a first toothing 311 of reverser wheel 31, while a second toothing 312 of reverser wheel 31 is meshed with the wheel of reduction wheel set 32. These first and second wheel sets, which are not visible in FIG. 2, can be seen in FIG. 3. Reverser wheel 31 forms a "free wheel": in a first direction of rotation of oscillating weight 2, the first toothing of first wheel set 311 of reverser wheel 31 is coupled with the second toothing of the second wheel set 312 of said reverser wheel, whereas in the second direction of rotation of oscillating weight 2, the first toothing 311 of reverser wheel 31 is uncoupled from the second toothing 312. The reverser wheel consists of a click system including studs on which arms 313 are mounted, secured to the first wheel set 311 (partially visible in FIG. 1 and also visible in the cross-section of FIG. 3), whereas stop members are formed at the periphery of second wheel set 312, which is also integral with a star-shaped hub on the axis of rotation thereof. The arms of click 313 cooperate with the hub and the stop members (not visible in FIG. 1) such that they drive the second wheel set in rotation in direction of rotation S1 of oscillating weight 2, and unclick in the opposite direction of rotation S2.

Figure 3:
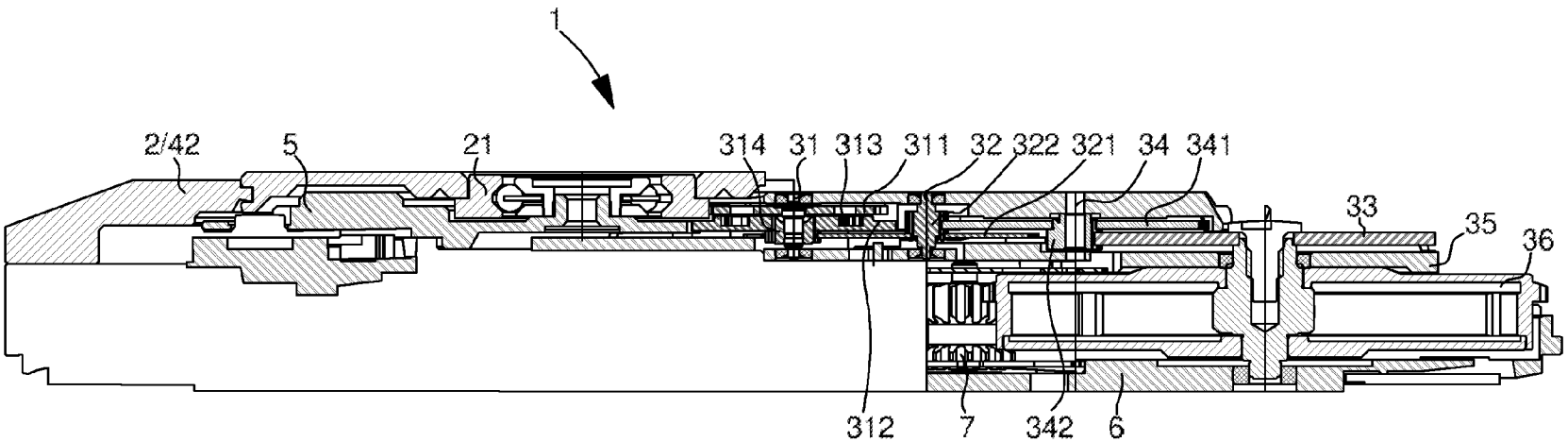
FIG. 3 is a cross-section of the device along the line III-III of FIG. 2.

Reduction wheel 32 meshing with reverser wheel 31 is rotatably mounted relative to support 5; it includes a reduction wheel 321 and pinion 322, both visible in FIG. 3. Reduction wheel 321 meshes with a wheel 341 of another reduction wheel set 34, also called an inter ratchet wheel, rotatably mounted on a bridge 35 integral with plate 6. Wheel 341 meshes with ratchet wheel 33 which enables the spring of barrel 36 to be wound.

As illustrated in FIG. 3, which is a cross-section along the line III-III of FIG. 2, ratchet wheel 33 of barrel 36 is rotatably mounted relative to bridge 35, but integral in rotation relative to the hub of barrel 36, and which meshes with the pinion 342 of second reduction wheel set 34 for automatically winding the movement. However, manual winding of barrel 36 is also possible via winding wheel 371, which also meshes with ratchet wheel 33. Winding wheel 371 is rotatably mounted relative to bridge 35 and can be set in rotation by the user who wishes to wind the watch manually by actuating a stem or crown fitted with an external knurling roller 372. The energy stored in the spring (not illustrated) of barrel 36 can, consequently, be obtained either by rotating oscillating weight 2, or by manual winding, the manual winding device 37 being formed by knurling roller 373 and winding wheel 371. This latter wheel is hidden in FIG. 2 by oscillating weight 2.

Movement 1 according to the invention also includes a vibrating alarm mechanism, which uses the same energy source 36 as that of automatic movement 1, and a kinematic chain 4 provided with an actuating device 41, visible in FIGS. 1 and 2, and a vibrating element 42. Actuating device 41 of the vibrating alarm device is formed in accordance with the variant illustrated by a click 411 and a spring 412, which prevent barrel 36 from rotating outside alarm times owing to the compression of click 411 on the toothing of one of the wheel sets of gear train 4, via spring 412, but release said toothing precisely when the alarm is set off at a predetermined time, which is preferably adjustable by the user. When the alarm goes off at a predefined time click 411 pivots to release the toothing from one of the wheel sets of the gear train of kinematic chain 4 and thus releases the energy stored in barrel 36. A control device (not shown) pivots click 411 between a locking position, outside the alarm time, and a release position during the alarm time.

According to the preferred embodiment illustrated by FIGS. 1 to 3, the vibrating element 42 of the vibrating alarm mechanism is oscillating weight 2. This element is consequently referenced 2/42 in FIGS. 2 and 3 to indicate that the same structural element corresponds to two distinct logical elements. This configuration maximises vibration amplitude without requiring any additional element to the movement, and thus saves space. Oscillating weight 2 in turn drives or is driven when it acts as vibrating element 42. Vibrating element 42 of the vibrating alarm mechanism, formed by oscillating weight 2, is intended to generate a vibration that can be detected on the user's wrist. When the watch is resting on a hard surface, the vibrations generated by the alarm mechanism will cause the watch to jump slightly, which will make a noise on impact with said surface.

The energy source used for powering the vibrating alarm mechanism and going train 7, formed by barrel 36 common to both kinematic chains 3 and 4, is purely mechanical here. However, it is possible to envisage another energy source, for example of electric or electromechanical power, for powering the vibrating alarm device of the invention, and/or the normal time display. It is, for example, possible to apply the invention to an ETA Autoquartz mechanism, wherein the mechanical energy from the oscillating weight is used for powering a generator, coupled to an accumulator which supplies electric energy to a Lavet type motor.

According to the preferred embodiment illustrated in FIGS. 1 to 3, the first and second kinematic chains 3, 4 have at least one element in common apart from barrel 36. According to the illustrated variant, all of the elements of kinematic chain 3, namely reverser wheel 31, and reduction wheels 32, 34 are also common to kinematic chain 4, from barrel 36 to oscillating weight 2, which is vibrating element 42 of the alarm mechanism. In other words, according to the illustrated embodiment, kinematic chains 3 and 4 are identical, such that all of the automatic winding chain wheel sets can be reused by the vibrating alarm mechanism without requiring any additional wheel sets. One could comment, however, that, unlike a usual winding mechanism, there is no click arranged on crown wheel 37 to allow energy to be stored in barrel 36. This click has been replaced by click 411, acting here on reverser wheel 31, but which could also act, according to other variants that are not shown, on any element of the gear train of the first kinematic winding chain 3, such as for example ratchet wheel 33, or one or other of reduction wheels 32, 34. Click 411 according to the invention consequently has a dual role: in addition to releasing the vibrating alarm mechanism, it acts on the winding mechanism to store energy in barrel 36, and thus replaces a conventional barrel click.

According to a preferred variant of the invention, the vibrating alarm mechanism, which uses the same kinematic chain as that of the winding mechanism of the movement, drives oscillating weight 2 forming vibrating element 42 of the alarm mechanism in the "free" direction of rotation, i.e. which does not cause the movement to be wound. When the energy stored in barrel 36 is released by click 411, the gear train elements 31, 32, 33, 34 of the first kinematic chain 3 are driven in the opposite direction to that observed when the barrel is being wound by oscillating weight 2 when these same elements are considered to form part of second kinematic chain 4. Indeed, the first kinematic chain 3 actuates reverser wheel 31 from weight pinion 21, and the rotation of the first wheel set 311 of said wheel 31 causes second wheel set 312 to rotate, meshing first reduction wheel 32, then inter ratchet wheel 34 and finally ratchet wheel 33 so as to wind the spring of barrel 36 in direction of rotation S1 of the weight pinion. However, the second kinematic chain starts from ratchet wheel 33 in the opposite direction towards inter ratchet wheel 34, then reduction wheel 33 towards reverser wheel 31, which this time drives first wheel set 311 from second wheel set 312 to mesh finally on weight pinion 21, driven in a direction of rotation S2 opposite to S1. The above remark also applies to crown wheel 371, which is driven in a first direction of rotation when movement 1 is being wound and in the opposite direction when ratchet wheel 33 releases the energy from the barrel towards vibrating element 42 formed by oscillating weight 2.

The cross-section of the movement in FIG. 3, illustrating a preferred variant of the invention wherein the two kinematic chains 3 and 4 are merged, shows more clearly the gearing of the various elements of the gear train common to said two kinematic chains 3 and 4. Thus, the gear train is shown starting from oscillating weight 2 and meshing on first wheel set 311 of reverser wheel 31, which drives second wheel set 312 and pinion 314 coaxial to said second wheel set 312, which in turn meshes with reduction wheel set 32, whose pinion 322 located above meshed wheel 321 drives in rotation wheel 341 of second reduction wheel set 34, whose bottom pinion 342 meshes with ratchet wheel 33, which winds the spring of barrel 36. The energy is released towards going train 7, whereas the click for retaining energy in barrel 36, formed in accordance with the invention by click 411 for releasing the vibrating alarm mechanism, is not shown, for the sake of legibility. Plate 6 is also seen, on which all the elements of the gear train are placed, as well as bridge 35 and support 5 of oscillating weight 2. The same gear train 33, 342, 341, 322, 321, 314, 312, 311, 21 is used in the opposite direction from ratchet wheel 33 to actuate rotation of the oscillating weight acting as vibrating element 42. Kinematic chain 4 for converting the energy from barrel 36 into the rotation of oscillating weight 2 winds the same gear train 3 as that used for winding barrel 36. It is therefore unnecessary to place another gear train starting from the toothing of barrel 36 in series with going train 7 for the vibrating alarm mechanism according to the invention.

The preferred variant of the timepiece movement according to the invention contains more than one device for limiting the duration of actuation of alarm 43, which sets an upper limit on energy removal from barrel 36 powering both going train 7 and the vibrating alarm mechanism, so that the release of said vibrating alarm does not adversely affect the proper operation of the movement, by altering the power reserve thereof in an excessively detrimental manner.

As illustrated in FIG. 1, according to a preferred variant of the invention, this device for limiting the duration of actuation of alarm 43 includes a wheel 432, which meshes with one of the elements of second kinematic chain 4, such as for example reduction wheel 32, common to both kinematic chains 3, 4 in accordance to the illustrated variant, and a second click 431, which meshes with said wheel 432. However, when device 43 for limiting the duration of actuation of the alarm meshes with an element common to kinematic winding chain 3 and second kinematic chain 4 for the vibrating alarm mechanism, as is the case of the illustrated embodiment, it must be ensured that said device is inactive when barrel 36 is being wound by said oscillating weight 2 and has a blocking effect when the alarm is released. This could be achieved by a particular arrangement of second click 431 and the notch in wheel 432, for example using oblique shapes so as to allow the click to operate in only one direction.

One drawback of the limiting mechanism of the variant described above is that, while it certainly sets an upper limit on the duration of the alarm, it never sets a lower limit. It is thus entirely possible for click 431 to be very close to the notch when the alarm is released and that in this configuration the alarm is stopped almost immediately after being released. This is why, according to a variant that is not illustrated, wheel 432 could also be formed of two wheel sets coupled in rotation in a similar manner to a reverser wheel, the first wheel set being integral with the notch which would house click 431, while the second wheel set would mesh with one of the elements common to both kinematic chains 3, 4, such as for example reduction wheel 32. If the wheel set of wheel 432 that meshes with the kinematic chains is arranged such that it unclicks when barrel 36 is being wound, it will then drive when the alarm is actuated and simply unclicking click 431 when the alarm is released will suffice to unblock limiting wheel 432. In this manner, the rotation of limiting wheel 432 would be not only limited, but permanently equal to one and only one complete revolution of limiting wheel 432 when the alarm is released. Thus, the duration of the alarm would be identical each time the alarm is set off, said duration then being determined solely by the number of teeth in limiting wheel 432.

Further, the gear ratios of the various elements of kinematic chains 3, 4 could thus be configured in combination with alarm duration limiting device 43 and in particular the number of teeth of limiting wheel 432, such that operation of the alarm is limited to one revolution of barrel 36 or any other unit determined by those skilled in the art which provides sufficient energy to generate vibrations for a sufficient period of time, of around ten seconds, without thereby unduly emptying barrel 36 by taking too much energy therefrom. This energy may also correspond to a fraction of a revolution of the barrel or a given number of barrel revolutions, depending upon whether the mechanism manufacturer wishes to prioritise the duration of the alarm to the detriment of the remaining power reserve. One could take into account in this regard that the user of a watch fitted with a vibrating alarm mechanism according to the invention will always tend to wind the watch each time the alarm mechanism has finished, so that even stopping the watch after the alarm has been released would not be detrimental for the user.

According to this embodiment which uses a mechanism 43 for limiting the duration of alarm operation, and for which it is desired that the mechanism is only actuated for a duration corresponding to a single rotation of limiting wheel 432, it would be necessary to couple the second alarm duration limiting click 431 with the first click 411 for blocking the vibrating alarm mechanism. Indeed, if one or other of these clicks 411, 431 is not released, it will be impossible to release the energy from barrel 36 towards oscillating weight 2 forming the vibrating element 42 of the vibrating alarm mechanism. This coupling could be achieved via a pin 44 integral with both clicks 411, 431 and shown in FIG. 1. Those skilled in the art will understand however that this coupling feature could be achieved regardless of the choice of the maximum alarm actuation duration, in particular if the duration is simply limited but not necessarily always equal, such as for example if limiting wheel 432 is formed of a single wheel set and an asymmetrical click, i.e. which allows barrel 36 to be wound by oscillating weight 2, but blocks the release of the vibrating alarm mechanism in the opposite direction of the same kinematic chain 3, 4.

Those skilled in the art will understand that the variants described above are given by way of example and must in no way be interpreted as limiting. The invention also concerns a watch, for example a wristwatch, including a case, and a timepiece movement according to any of the previously described embodiments housed in said case.

REFERENCE LIST

| | |
|---|---|
| 1 | Movement |
| 2 | Oscillating weight |
| 21 | Weight pinion |
| 211 | Axis of rotation of the weight pinion |
| 3 | Kinematic chain for automatic winding |
| 31 | Reverser wheel |
| 311 | First wheel set of the reverser wheel |
| 312 | Second wheel set of the reverser wheel |
| 313 | Clicks fixed to the first wheel set of the reverser wheel |
| 314 | Pinion of the second wheel set of the reverser wheel |
| 32 | First reduction wheel set |
| 321 | Wheel of the reduction wheel set |
| 322 | Pinion of the reduction wheel set |
| 33 | Ratchet wheel of barrel 36 |
| 34 | Second reduction wheel set (inter ratchet wheel) |
| 341 | Wheel of the second reduction wheel set |
| 342 | Pinion of the second reduction wheel |
| 35 | Bridge integral with the plate |
| 36 | Barrel of the automatic movement |
| 37 | Manual winding mechanism of barrel 36 |
| 371 | Crown wheel for winding barrel 36 |
| 372 | Winding stem for barrel 36 |
| 4 | Kinematic chain for the vibrating alarm mechanism |
| 41 | Device for actuating the vibrating alarm |
| 411 | Click |
| 412 | Spring |
| 42 | Vibrating element of the vibrating alarm mechanism |
| 43 | Device for limiting the duration of actuation of the vibrating alarm |
| 431 | Wheel for limiting the duration of actuation of the vibrating alarm |
| 432 | Click for limiting the duration of actuation of the vibrating alarm |
| 44 | Coupling pin for clicks 411, 431 |
| 5 | Oscillating weight support |
| 6 | Plate |
| 7 | Going train |

What is claimed is:

1. A timepiece movement including:

(a) an energy source, wherein the energy source is coupled to an oscillating weight by a first kinematic chain for automatically winding the movement, and wherein the energy source is also coupled to an actuating device and to a vibrating element by a second kinematic chain to form a vibrating alarm mechanism that is releasable at a predetermined time, wherein the vibrating element of the vibrating alarm mechanism is the oscillating weight.

2. The timepiece movement according to claim 1, wherein said second kinematic chain has at least one element common to said first kinematic chain.

3. The timepiece movement according to claim 1, wherein said energy source is a barrel that can be wound using a manual winding mechanism.

4. The timepiece movement according to claim 3, wherein said second kinematic chain has at least one element common to said first kinematic chain.

5. The timepiece movement according to claim 3, wherein said second kinematic chain is identical to the first kinematic chain.

6. The timepiece movement according to claim 3, further including:

(b) a device for limiting the duration of actuation of the alarm.

7. The timepiece movement according to claim 6, wherein gearing ratios of the second kinematic chain and the device for limiting duration of actuation of the alarm are configured so that the energy used for operating the alarm is limited to one revolution of the barrel.

8. The timepiece movement according to claim 6, wherein alarm actuation duration corresponds to a duration determined by one and only one revolution of the limiting wheel of said device for limiting duration of actuation of the alarm.

9. The timepiece movement according to claim 1, wherein said vibrating alarm mechanism is prevented from rotating by a first click outside the alarm times, and is free to rotate when the alarm is released.

10. The timepiece movement according to claim 9, wherein said first click acts on one of a plurality of gear train elements of said first kinematic chain.

11. The timepiece movement according to claim 9, further including:

(b) a device for limiting duration of actuation of the alarm.

12. The timepiece movement according to claim 9, wherein said energy source is a barrel that can be wound using a manual winding mechanism.

13. The timepiece movement according to claim 11, wherein said device for limiting duration of actuation of the alarm includes a wheel meshing with said second kinematic chain and a second click meshing with said wheel.

14. The timepiece movement according to claim 11, wherein said device for limiting duration of actuation of the alarm meshes with an element common to said first kinematic chain and said second kinematic chain, wherein said device for limiting duration of actuation of the alarm is inactive when said energy source is being wound by said oscillating weight and has a blocking action when the alarm is released.

15. The timepiece movement according to claim 13, wherein said second click is coupled to said first click of said vibrating alarm mechanism.

16. The timepiece movement according to claim 1, wherein said second kinematic chain is identical to the first kinematic chain.

17. The timepiece movement according to claim 16, wherein the energy stored in the energy source actuates gear elements of the first kinematic chain in an opposite direction to that observed when the energy source is being wound by the oscillating weight.

18. A watch including a case and a timepiece movement according to claim 1, housed in said case.

* * * * *